United States Patent [19]

Anthony et al.

[11] Patent Number: 4,695,760

[45] Date of Patent: Sep. 22, 1987

[54] SELF-ALIGNED DOUBLE GRIDS FOR VACUUM TUBES

[75] Inventors: Thomas R. Anthony, Schenectady; Philip A. Lindner, Liverpool, both of N.Y.; Jewell G. Tucker, Owensboro, Ky.

[73] Assignee: General Electric Company, Schenectady, N.Y.

[21] Appl. No.: 339,955

[22] Filed: Jan. 18, 1982

[51] Int. Cl.[4] ..... H01J 1/46; H01J 1/52; H01J 17/04; H01J 17/12; H01J 19/38; H01J 19/40; H01J 21/10

[52] U.S. Cl. ..... 313/348; 313/296; 313/355; 313/597; 313/631

[58] Field of Search ..... 313/243, 292, 296, 299, 313/307, 348, 355, 597, 631

[56] References Cited

U.S. PATENT DOCUMENTS 3,744,247 7/1973 Margosian et al. ..... 313/631

*Primary Examiner*—Robert E. Wise

*Attorney, Agent, or Firm*—James Magee, Jr.; James C. Davis, Jr.

[57] ABSTRACT

Self-aligned double grids for vacuum tubes and methods for making such double grids are provided. The self-aligned double grids are especially suitable for improving the efficiency and performance characteristics of high frequency power amplifier tetrode tubes.

50 Claims, 13 Drawing Figures

SELF-ALIGNED DOUBLE GRIDS FOR VACUUM TUBES

This invention pertains to vacuum tube technology in general and more particularly to self-aligned double grids for vacuum tubes and methods for making the same.

The simplest amplifying vacuum tube is the triode consisting of a cathode, a control grid and an anode known as the plate. The grid, frequently in the form of a wire mesh or screen having a low ratio of wire area to open area, is situated in close proximity to the cathode.

During operation of the tube, the cathode of the vacuum triode is heated to the temperature required for thermionic emission of electrons. The plate is maintained positive with respect to the cathode and, as a consequence, electrons flow from the cathode to the plate. Because of its proximity to the cathode, a small negative potential on the grid with respect to the cathode can counteract the attractive force of the relatively large positive potential of the plate and cause current flow across the tube to cease. As the grid is made less negative (more positive), more and more electrons will be able to pass through the grid and flow to the positive plate. Thus, in this manner, the grid-to-cathode voltage controls the current from a power supply connected between the cathode and the plate. For a given grid voltage, the plate current increases monotonically with the plate voltage. Conversely, at a given plate voltage, the plate current increases with increasing grid voltage.

The electrical properties of the vacuum triode described above are called the static characteristics because they are obtained from direct current (DC) measurements. It is also a characteristic of vacuum triodes that there are small capacitances between the grid and cathode, grid and plate, and plate and cathode. Those capacitances are not measured by the direct currents used to determine the static characteristics. However, since an alternating current, I, is proportional to the capacitance times the time-derivative of the voltage ($I=C\,dv/dt$), the very small capacitances between grid and cathode, grid and plate and plate and cathode may draw appreciable current when the tube is operated in an alternating current (AC) mode. In fact, those interelectrode capacitances are limiting factors in the high frequency performance of tubes especially those operated in the microwave region (generally 200 megahertz (MHz) to 100 gigahertz (GHz)) of the electromagnetic spectrum. The grid-to-plate capacitance, although only a few picofarads, is particularly bothersome because it not only decreases the possible amplification by capacitive shorting, but it also provides a path whereby some of the output signal of the tube is fed back into the input signal of the tube possibly resulting in unwanted oscillations.

One way to reduce the grid-to-plate capacitance is to insert a second grid, termed a screen grid, in the vacuum tube between the control grid and the plate to provide an electrostatic shield between the control grid and the plate. This screen grid is operated with a positive potential of the order of the plate voltage. One result of the use of a screen grid, an advantage, is that variations in the plate voltage have little effect on the potential distribution near the cathode and therefore do not affect the plate current. Thus, the relative effect of the grid voltage on the plate current is increased and thus the voltage amplification capability of the tube is enhanced.

A large percentage of the electrons leaving the cathode, approximately 25 to 35% in current high power vacuum tubes, are captured by the screen grid, and thus never reach the plate, thereby reducing tube efficiency. The capture of electrons by the screen grid is primarily due to the attractive effect of the positive screen grid for negative electrons, the mutually repulsive effect of electrons which tends to repel them into the screen grid, and physical misalignment between the control and screen grids.

Previous attempts to carefully align the control and screen grids to improve vacuum tube efficiency have proved difficult, costly and generally ineffective. Further, with current state-of-the-art wire mesh grids, microphonics, or grid vibrations, operate to counteract the potential benefits of carefully engineered and aligned grids. The adverse effects of grid vibrations increase with increasing frequency at which the vacuum tubes operate and thus are particularly detrimental to the performance of high frequency power amplifier tubes such as ultra-high frequency (UHF) tetrodes.

The method of this invention provides self-aligned double grids which may be used to improve the efficiency and performance characteristics of vacuum tubes. Since the self-aligned grids are physically positioned on the same substrate or structure in close proximity to each other, smaller grid currents will be required for the double grids of the invention compared to conventional grid arrangements thereby improving device efficiency. Additionally, inefficiencies in prior art tube designs due to physical misalignment of the grids are obviated. Further, by physically positioning the grids on the same structure, grid vibrations are largely eliminated and performance characteristics are improved.

Briefly, the method of the invention for producing the self-aligned double grids comprises the steps of first making a plurality of cut-out regions in at least a portion of a substrate having first and second major surfaces and an outer peripheral edge area interconnecting the major surfaces and defininf the shape of the substrate. The cut-outs are arranged in an array or pattern separated by grid members or a lattice work of the material of the substrate within the perimeter of the array or pattern. Alumina has been found to be a suitable material for the substrate and a laser beam has been found to be an effective means for making the cut-outs. Second, a first thin planar layer of a conducting material is applied to the first major surface of the substrate and a second thin planar layer of a conducting material is applied to the second major surface of the substrate in a manner such that the layers on the opposite major surfaces of the substrate are electrically isolated. This step is effectively accomplished by selectively masking the substrate, particularly the interior peripheral edge area of the cut-outs. Sputtering has been found to be an effective means for applying the layers and tungsten, whose coefficient of thermal expansion is nearly equal to that of alumina, a suitable material for the conducting layers.

Similarly, and briefly, the article of the invention comprises a substrate having first and second major surfaces and an outer peripheral edge area which interconnects the major surfaces and defines the overall shape of the substrate. A plurality of cut-outs, arranged in an array or pattern, is located in at least a portion of the substrate. Each cut-out has an inner or interior peripheral edge area which interconnects a first aperture lying in the plane of the first major surface and a second aperture lying in the plane of the second surface. A first thin planar layer of a conducting material overlies and is contiguous with the first major surface and a second thin planar layer of a conducting material overlies and is contiguous with the second major surface. The first and second layers of conducting material are electrically isolated from each other and do not cover the apertures thereby providing substantially identical pairs of open areas in register with each other in the two layers.

The practice of the invention may be more fully understood, and its features and advantages more readily appreciated, by the detailed description and Examples provided hereinbelow and with reference to the appended FIGS. wherein, briefly:

Figure 1:
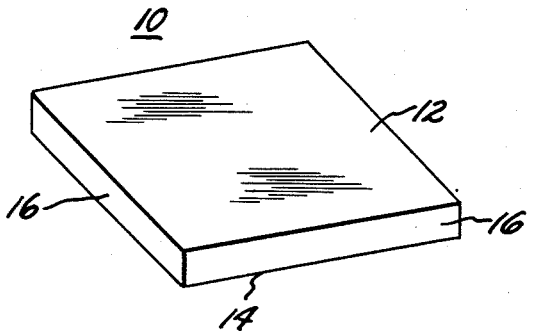
FIG. 1 is a schematic dimensional representation of a planar substrate suitable for use in the practice of this invention.
Figure 1A:
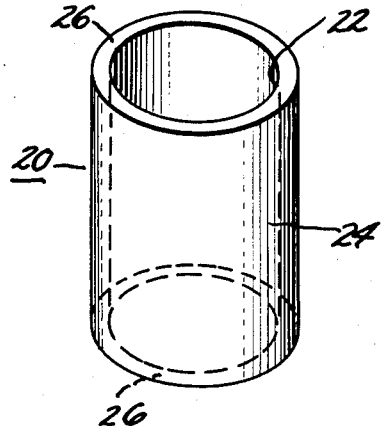
FIG. 1A is a schematic dimensional representation of a hollow cylindrical substrate suitable for use in the practice of this invention.

In FIGS. 1 and 1A there are shown two examples of substrates suitable for use in the practice of the invention. Planar substrate 10 of FIG. 1 typically has first 12 and second 14 major surfaces with outer peripheral edge area 16 interconnecting major surfaces 12 and 14. The shape of area 16 will be dictated by the design of the vacuum tube device (not shown) with which the completed self-aligned double grids of the invention will be utilized and circles, squares and rectangles are, for example, within the contemplation of the invention. Hollow cylindrical substrate 20 of FIG. 1A has first or inner 22 and second or outer 24 major cylindrical surfaces with outer peripheral edge areas 26 interconnecting cylindrical surfaces 22 and 24. The material of the substrate must be capable of withstanding thermal cycling between ambient temperature and the operating temperature of the vacuum tube device and, as will be described below in more detail, must be compatible with the thin planar layer of conducting material to be applied to the major surfaces. Alumina has been found to be a particularly suitable material.

Figure 2:
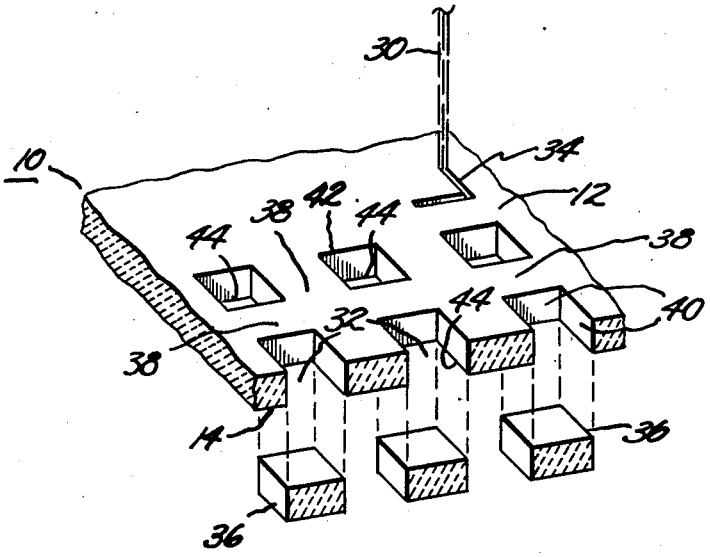
FIG. 2 is a schematic dimensional representation in partial cross-section of a portion of the substrate of FIG. 1 undergoing preparation of an array of cut-outs by laser beam means.

An array or pattern of cut-outs is next fabricated in at least a portion of the substrate. A laser beam has been found to be an acceptable means for fabricating the cut-outs, especially in alumina. In FIG. 2, laser beam 30, which has fully penetrated the thickness of substrate 10, is shown in the process of making cut-outs 32 by being scanned about the periphery of a cut-out to be formed. The heat from laser beam 30 effectively vaporizes the material of the substrate about the periphery forming kerf 34 permitting the material inside kerf 34, termed "punchouts" 36, to fall away from substrate 10. If the laser beam has insufficient power in the scanning mode to continuously remove the substrate material to form kerf 34, the laser may be used to form kerf 34 by "drilling" a series of overlapping holes about the periphery of the cut-outs to be formed thereby freeing punchouts 36.

Generally, punchouts 36 inside the laser-scanned or laser-drilled periphery or kerf 34 will fall away spontaneously from substrate 10 leaving cut-outs 34 separated by a lattice-work 38 of the material of substrate 10. In the event that punchouts 36 do not readily separate from substrate 10, substrate 10 may be immersed in an etchant bath (not shown), preferably with ultrasonic agitation, in which the material of substrate 10 is soluble. The etchant will dissolve any remainining "bridges" between punchouts 36 and lattice work 38. Use of the etchant is also advantageous in that it tends to smooth away any rough edges along interior peripheral edge areas 40 of cut-outs 32. Interior peripheral edge areas 40 interconnect first 42 and second 44 apertures of cut-outs 32 and lie in the planes of first 12 and second 14 major surface of substrate 10, respectively.

Figure 3:
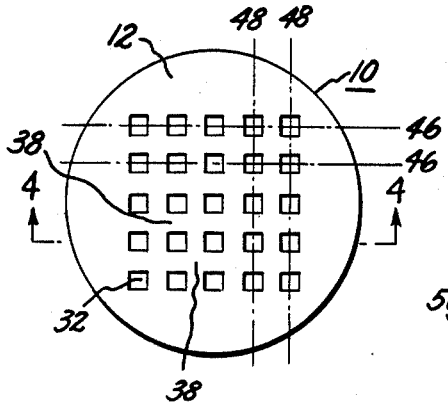
FIG. 3 is a top elevation view of a circular substrate having a square array of square cut-outs therein.

An example of a completed array within a portion of substrate 10 is shown in FIG. 3. The array of FIG. 3 is a square array, i.e., the spacing between orthogonal center-lines 46 and 48, which pass through the geometric centers of square cut-outs 32, is the same. The invention, however, is not limited to square cut-outs nor square arrays thus allowing great flexibility in the design and arrangement of the cut-outs. For example, it is within the contemplation of the invention that cut-outs 32 be circular and that the array be formed by arranging the circular cut-outs about the peripheries of a series of concentric circles. The term array refers to an arrangement of cut-outs having a regular or repeating periodicity. Cut-outs 32 need not be formatted in the rigorous arrangment termed an array as a less structured arrangement, a pattern, may be desirable.

The next step is to apply a thin layer of a conducting material to major surfaces 12 and 14 of substrate 10. In preparation for this step, interior peripheral edge areas 40 and outer peripheral edge area 16 are masked. This step is performed to ensure that the layer of conducting material on surface 12 is electrically isolated from the layer of conducting material on surface 16.

Figure 4:
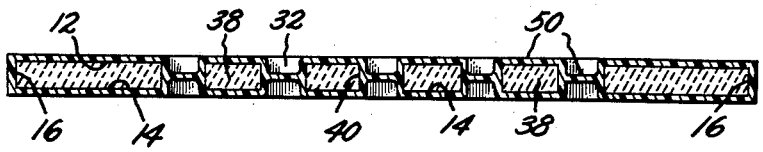
FIG. 4 is a schematic front elevation view in cross-section of the substrate of FIG. 3 taken along line 4—4 following the formation of a butyl acetate film over the major and edge surfaces and in the interstices of the cut-outs.

One masking method that has been found effective is to immerse substrate 10 into a bath (not shown) of a liquid solution of 15% butyl acetate and 85% acetone (by weight). After withdrawal of substrate 10 from the bath, and evaporation of the acetone, a continuous solid film 50 is left on surfaces 12, 14, and 16 and in the interstices of cut-outs 32 as is shown schematically in FIG. 4 for the substrate of FIG. 3.

Figure 4A:
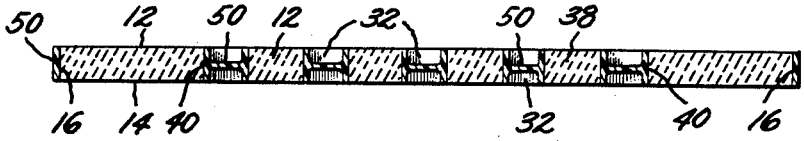
FIG. 4A is a schematic front elevation view in cross-section of the substrate of FIG. 4 following removal of the butyl acetate film from the top and bottom major surfaces.

Shrinkage of butyl acetate film 50 upon drying enabled film 50 to be peeled off of major surfaces 12 and 14 from edge area 16 up to the beginning of the array structure since the cut-outs at the outer perimeter of the array acted as lines of perforations. The remainder of film 50 within the perimeter of the array was removed by gentle rubbing with 600 grit silicon carbide grinding paper. A desirable feature of butyl acetate film 50 is that it pulverizes and breaks into minute pieces rather than smearing as would wax or other such compounds. Substrate 10 now has surfaces 12 and 14 exposed, clean and free from foreign matter while the interstices of cut-outs 32, including inner peripheral edge areas 40, and outer peripheral edge area 16 are covered and blocked by butyl acetate film 50 as shown in FIG. 4A.

A thin planar film of a conducting material is next deposited over surfaces 12 and 14 of substrate 10. The material of the thin film must be well bonded to surfaces 12 and 14 so that mechanical vibrations and thermal cycling do not cause delamination of the film from the underlying substrate. For alumina with a thermal expansion coefficient of $6\times10^{-6}$°C.$^{-1}$ tungsten, with a thermal expansion coefficient of $4.5\times10^{-6}$°C.$^{-1}$ provides an almost perfect thermal expansion match. Tungsten is also attractive since it forms a strong bond with alumina.

Of the various means of depositing tungsten on the alumina substrate, sputter deposition is preferred since sputtering results in the best bonding between the deposited thin conducting film and the underlying substrate.

The deposited thin films of conducting material typically carry currents in the microampere range thus the film thickness is dictated by a need to compensate for any erosion over the life of the tube and by a need to minimize thickness to minimize mechanical constraint between the film and the substrate. Thus, film thickness in the range of from about 0.1 micrometer to about 25 micrometers is preferred.

It is preferable to sputter in a series of runs of short duration instead of one long continuous run to avoid overheating the substrate thereby destroying the butyl acetate film. There is no requirement that the same material be deposited on both surfaces 12 and 14. It is also not necessary that the thin layers of conducting material be deposited over 100% of surfaces 12 and 14. It is only necessary that the conducting material be applied within and slightly beyond the perimeter of the array, thus an effective means of masking outer peripheral edge area 16 is to place a mask having a suitably sized opening to expose the array onto surfaces 12 and 14 prior to sputtering.

Figure 5:
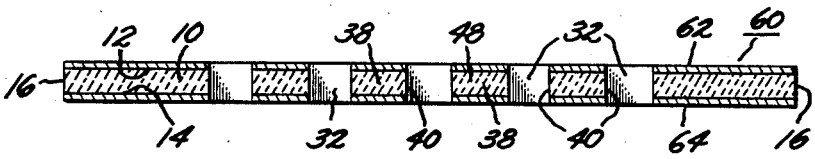
FIG. 5 is a schematic front elevation view in cross-section of the substrate of FIG. 4A following formation of a thin planar layer of a conducting material over the major surfaces and removal of the butyl acetate film from the interstices of the cut-outs.
Figure 6:
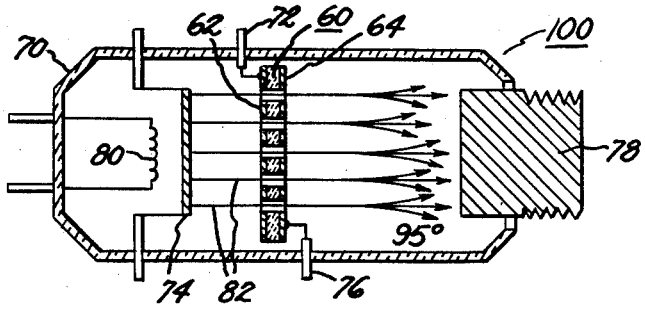
FIG. 6 is a schematic representation in cross-section of the self-aligned double grid of FIG. 5 in a high power, high frequency microwave tube device.

Substrate 10 with the deposited thin planar conducting layers is next soaked in an acetone bath, preferably with ultrasonic agitation, to remove both the butyl acetate and overlying tungsten deposit from the interstices of the alumina grid structure to complete the fabrication of the self-aligned double grid composite structure 60 of the invention shown in FIGS. 5 and 6.

Self-aligned double grid 60 is shown in FIG. 6 schematically in use in vacuum tube device 100 which is illustrated in the form of a typical high power high frequency microwave tube. Connection 72 is made to thin planar conducting layer 62 on surface 12 of substrate 10 facing cathode 74 and connection 76 is made to thin planar conducting layer 64 on surface 14 of substrate 10 facing anode 78 through vacuum-sustaining enclosure 70. Thus layers 62 and 64

With this construction the periphery of each open area in grid 62 is permanently aligned (i.e., in register) with the periphery of an open area of substantially identical size and configuration in grid 64 and at the same time the grids are electrically isolated from each other.

Figure 6A:
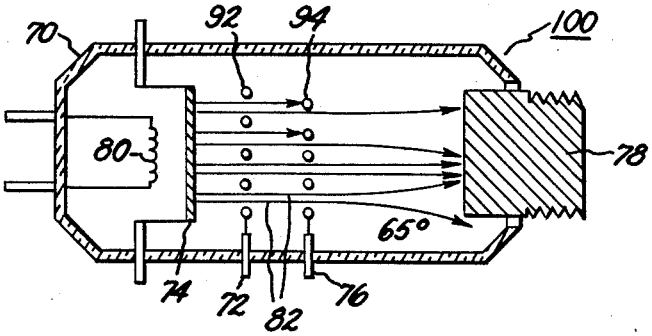
FIG. 6A is a schematic representation in cross-section of a typical prior art high power, high frequency vacuum tube having separate screen and control grids.

In operation, cathode 74 is heated by heater 80 to a temperature sufficient to cause thermionic emission of beams of electrons 82 which pass through cut-outs 32 in self-aligned double grid 60. In passing through double grid 60 the electrons in beams 82 are acted upon by control and screen grids 62 and 64, respectively. Since grids 62 and 64 are aligned, approximately 95% of the electrons generated at cathode 74 should reach anode 78. In contrast, in the prior art version of tube 100 of FIG. 6A, having separate wire mesh control and screen grids 92 and 94, respectively, only about 65% of the electrons generated at cathode 74 reach anode 78 due to physical misalignment of grids 92 and 94 and the adverse effects of the attractive force of positive screen grid 94 for negative electrons and the mutually repulsive forces between electrons in beams 82.

Alternatively, it has been found that the thin layers of conducting material may first be applied to major surfaces 12 and 14 by sputter deposition to form an assembly and that the array of cut-outs 32 may subsequently be formed by laser-scanning or laser drilling through such assembly. An advantage of this embodiment of the invention is that it is not necessary to conduct the additional steps required to mask interior peripheral edge areas 40. Disadvantages, however, are that the conducting material tends to reflect the laser beam thus reducing the efficiency of the laser machining process and that vaporized conducting material which may be redeposited on interior peripheral edge areas 40 may cause short circuits between the layers of conducting material on opposite major surfaces. Immersion in an etchant bath, which is used to dissolve any remaining "bridges" between punchouts 36 and lattice work 38, is also helpful with this embodiment in removing stray areas or bits of redeposited conducting material.

In another embodiment useful in such linear beam or "guided-grid" type tubes as cathode-ray tubes, at least one cut-out may be laser-drilled axially through a solid cylindrical piece of substrate material. This would yield the hollow cylindrical substrate of FIG. 1A with which cut-outs 26 would normally be formed radially between major cylindrical surfaces 12 and 14. Thereafter, thin metallic layers of a conducting material would be applied to opposite peripheral edge areas 26. Thus, for example, self-aligned pairs of electrodes such as the control electrode and screen grid (or accelerator) or the focusing electrode and accelerating electrode of a cathoderay tube may advantageously be made on single insulating substrates.

The following Examples are provided by means of illustration, and not by way of limitation, to further instruct those skilled in the art of the practice of the invention.

EXAMPLE I

A 15 by 15 array of square cut-outs 0.020 inch by 0.020 inch separated by 0.003 inch wide grid members was formed in an 0.8 inch diameter by 0.008 inch thick alumina wafer by laser drilling a series of overlapping holes through the wafer around the perimeters of the square cut-outs with a Nd YAG laser (Control Laser Model 512) having 6 watts average power when operated in the Q-switched mode at a 3 kHz repetition rate with 19 amps lamp current and an 80 mil aperture.

Figure 7:
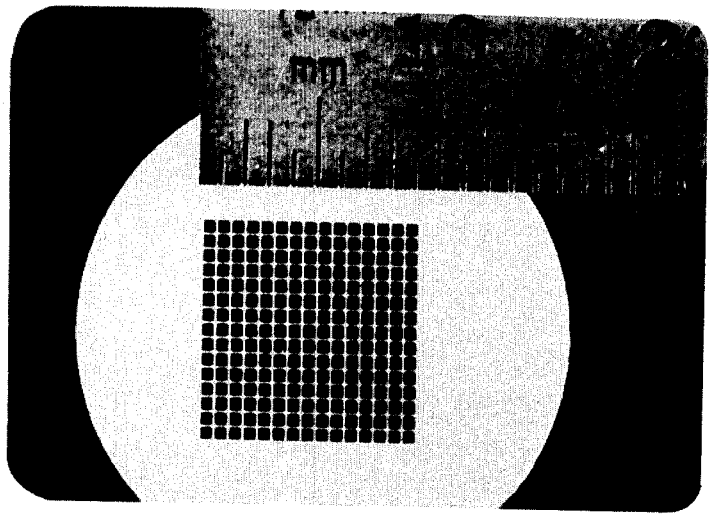
FIG. 7 is a photograph at 4× magnification of the 15×15 square grid structure of Example 1 prior to the sputtering of the thin planar layers of conducting material over the major surfaces.
Figure 7A:
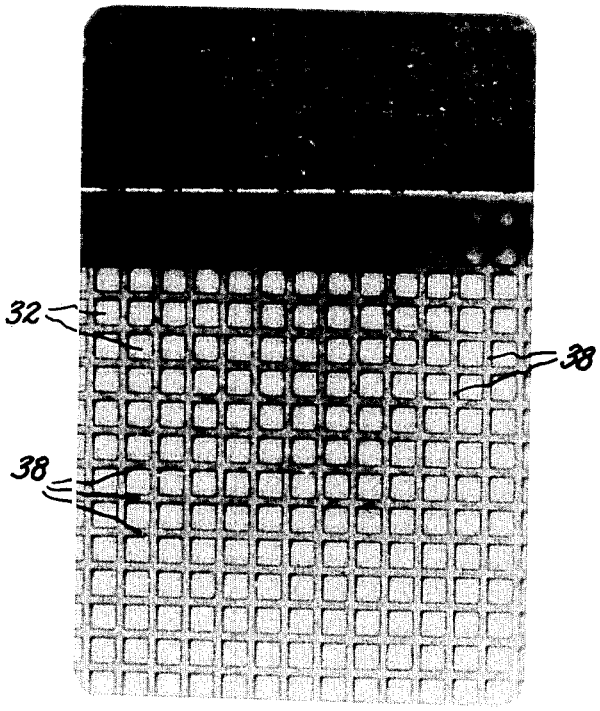
FIG. 7A is a photograph at 10× magnification of the grid structure of FIG. 6.

All of the squares did not fall out of the alumina wafer because of a few remaining "bridges" between the grid members and the material ("punchouts") inside the peripheries of the square cut-outs. These punchouts were removed by placing the wafer in a boiling bath of 50% KOH for 15 minutes and subjecting the bath to ultrasonic agitation. This combination of a slight etch plus the mechanical impulses of the ultrasonic waves removed all of the punchouts leaving the desired square array of 20 mil square cut-outs separated by 3 mil wide grid members between adjacent cut-outs as shown in FIG. 7 at 4× and in FIG. 7A at 10×.

The wafer was next immersed in a liquid solution of 15% butyl acetate and 85% acetone (by weight), removed from the solution, and allowed to dry. Upon subsequent evaporation of the acetone, a solid continuous film of butyl acetate was left behind on the surfaces of the wafer and in the interstices of the square cut-outs. The butyl acetate film was peeled away from the planar surfaces of the wafer beyond the perimeter of the array leaving behind an integral coherent film on the 0.003" wide alumina grid members. The grid member area of the alumina wafer was gently rubbed with 600 grit silicon carbide grinding paper to remove the butyl acetate film from the grid members.

The prepared wafer was placed in a sputtering chamber and a 0.1 micron thick layer of tungsten was sputtered onto the major surfaces of the alumina wafer in a series of five 30-second runs. Prior to commencing the sputtering, the area of the wafer beyond the perimeter of the array was masked with a metal washer to prevent tungsten from depositing on the outer peripheral edge area of the wafer. A series of runs was used instead of one long continuous run to avoid overheating the wafer and destroying the butyl acetate film.

Figure 8:
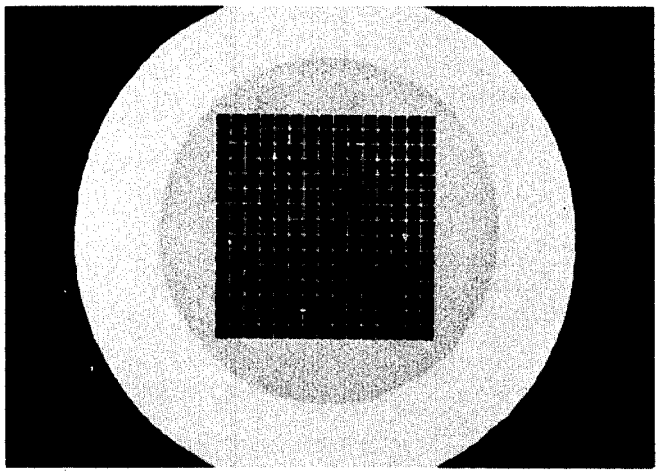
FIG. 8 is a photograph at 4× magnification of the completed self-aligned double grid of Example 1.

The wafer with the deposited tungsten was soaked in acetone for a minute and then agitated by ultrasonic waves for one second to remove the butyl acetate and overlying tungsten deposit from the interstices of the cut-outs. The resulting self-aligned double grid is shown in FIG. 8. The resistance between the metal grids on the opposite major surfaces was found to exceed 10,000 ohms.

EXAMPLE II

Figure 9:
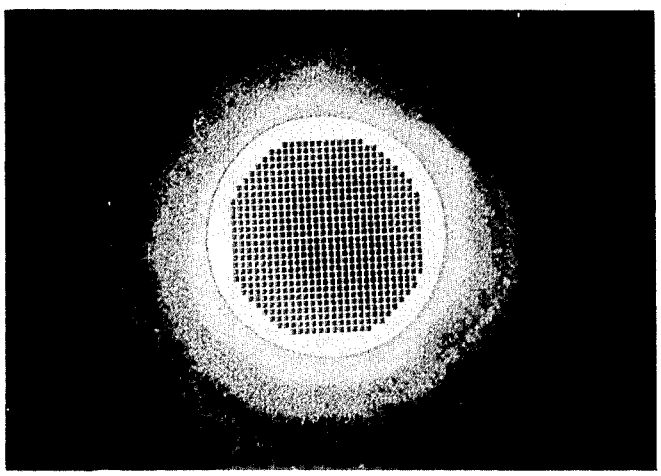
FIG. 9 is a photograph at 2× magnification of the grid structure of Example 11.

The self-aligned double grid of FIG. 9 was produced by first sputter depositing a 0.1 micron thick layer of tungsten on both sides of a 0.8 inch diameter by 0.008 inch thick alumina wafer. The array of 0.020 inch by 0.020 inch square cut outs separated by 0.003 inch wide grid members shown in FIG. 9 was then laser-drilled using the laser and laser drilling parameters of Example I. This grid is particularly suitable for use in high frequency, high power vacuum tubes used in such applications as microwave transmission and radar.

While the invention has been particularly shown and described with reference to several preferred embodiments thereof, it will be understood by those skilled in the art that various changes in form and detail may be made therein without departing from the true spirit and scope of the invention as defined by the appended claims.

What is claimed is:

1. A method for making a composite structure providing first and second electrically conducting grid members with predetermined spacing therebetween comprising the steps of:

(a) providing a body of electrically non-conducting material having first and second opposed surfaces spaced apart to the extent of said predetermined spacing;

(b) employing a laser beam to cut a plurality of openings of pre-set shape, spacing and orientation through said body with the central axes of said openings being substantially parallel;

(c) covering the inside surfaces of said openings with a removable coating material, said first and second opposed surfaces being free of said coating material;

(d) bonding a first electrically conducting grid member having a first set of open areas therein to said first opposed surface and bonding a second electrically-conducting grid member having a second set of open areas therein to said second opposed surface, the periphery of each open area of said first set being permanently aligned with the periphery of an open area of said second set, each pair of aligned open areas being of substantially identical size and configuration and having the central axis of said pair substantially coincident with the central axis of one of said openings, and (e) removing said coating material.

2. The method of claim 1 wherein the openings are provided by penetrating a laser beam through the body and scanning said beam about the periphery of the openings to be formed.

3. The method of claim 1 wherein the openings are provided by drilling by means of a laser beam a series of overlapping holes through the body and about the periphery of the openings to be formed.

4. The method of claim 2 or 3 further including the step of immersing the body in an etchant in which the material of said body is soluble

5. The method of claim 1 wherein the material of the body is alumina.

6. The method of claim 5 wherein the material of the grid members is tungsten.

7. The method of claim 1 wherein the electrical isolation between said grid members of a conducting material on said first major surface and said of a conducting material on said at least about 10,000 ohms.

8. The method of claim 1 wherein the thickness of the substrate is about 8 mils, said cut-outs are in the form of squares about 20 mils on a side, said array is a square array, and the width of the grid members between adjacent cut-outs is about 3 mils.

9. The method of claim 1 wherein the thickness of each grid is between about 0.1 micron and about 25 microns.

10. A method for making self-aligned double grids comprising the steps of:

(a) providing an array of a plurality of cut-outs in at least a portion of a substrate, said substrate having first and second major surfaces and an outer peripheral edge area interconnecting said major surfaces, each said cut-out having an interior peripheral edge area interconnecting a first aperture lying in the plane of said first major surface and a second aperture lying in the plane of said second major surface;

(b) applying a masking material to each said interior peripheral edge area and to said outer peripheral edge area;

(c) applying a first thin planar layer of a conducting material to said first major surface and a second thin planar layer of a conducting material to said second major surface; and (d) removing said masking material from each said interior edge area and said outer peripheral edge area leaving thereby said first thin planar layer of a conducting material electrically isolated from said second thin planar layer of a conducting material.

11. The method of claim 10 wherein said cut-outs are provided by penetrating a laser beam through the thickness of said substrate and scanning said beam about the periphery of the illegible-outs to be formed.

12. The method of claim 10 wherein said cut-outs are provided by drilling by means of a laser beam a series of overlapping holes through the thickness of said substrate and about the periphery of the cut-outs to be formed.

13. The method of claim 11 or 12 further including the step of immersing said substrate in an etchant in which the material of said substrate is soluble thereby enhancing removal of the material of said substrate interior to said periphery.

14. The method of claim 10 wherein said masking material comprises a solid film of butyl acetate.

15. The method of claim 14 wherein said removing step comprises the steps of immersing said substrate in a bath of acetone and agitating said bath by ultrasonic means for a period of time sufficient to remove said masking material.

16. The method of claim 10 wherein said step of applying said first and second thin planar layers of a conducting material comprises sputtering.

17. The method of claim 10 wherein the material of said substrate is alumina.

18. The method of claim 17 wherein said conducting material of said first and second thin planar layers is tungsten.

19. The method of claim 18 wherein the electrical isolation between said thin planar layer of a conducting material on said first major surface and said thin planar layer of a conducting material on said second major surface is at least about 10,000 ohms.

20. The method of claim 19 wherein the thickness of said substrate is about 8 mils, said cut-outs are in the form of squares about 20 mils on a side, said array is a square array, and the width of the grid members between adjacent cut-outs is about 3 mils.

21. The method of claim 10 wherein the thickness of said first thin planar layer of a conducting material and the thickness of said second thin planar layer of a conducting material is between about 0.1 micron and about 25 microns.

22. A composite structure providing first and second spaced electrically conducting grids for use in a vacuum tube device to function as control and screen grids, respectively; the periphery of each open area of said first grid being in permanent alignment with the periphery of an open area of substantially identical size and configuration in said second grid via an opening extending through an electrically non-conducting substrate; said grids being electrically isolated and bonded to opposite faces of said substrate to provide exposed outer surfaces for both sides of said structure.

23. The composite structure of claim 22 wherein the material of the substrate is alumina.

24. The composite structure of claim 23 wherein the material of the first and second grids is tungsten.

25. The 24 composite structure of claim 22 wherein the extent of electrical isolation between the grids is at least about 10,000 ohms.

26. The composite structure of claim 22 wherein the thickness of the substrate is about 8 mils, the open areas are in the form of squares about 20 mils on a side and are arranged in a square array, and the width of the grid members between adjacent open areas is about 3 mils.

27. The composite structure of claim 22 wherein the thickness of the grids is between about 0.1 micron and about 25 microns.

28. The composite structure of claim 22 wherein the peripheries of each permanently aligned pair of open areas are also in alignment with the periphery of the intervening opening through the substrate.

29. In a vacuum tube device comprising a vacuum-sustaining enclosure containing means for generating electrons, a control grid, a screen grid and an anode, said grids being in spaced relationship and being provided with separate means for making electrical connection thereto the improvement wherein the control and screen grids are bonded to opposite faces of an electrically non-conducting substrate as a composite structure and the periphery of each open area of said control grid is in permanent alignment with the periphery of an open area of substantially identical size and configuration in said screen grid via an opening extending through said substrate, said grids being electrically isolated and providing exposed outer surfaces for said composite structure.

30. The improved vacuum tube device of claim 29 wherein the material of said substrate is alumina.

31. The improved vacuum tube device of claim 30 wherein the material of the grids is tungsten.

32. The improved vacuum tube device of claim 29 wherein the electrical isolation between the grids is at least about 10,000 ohms.

33. The improved vacuum tube device of claim 29 wherein the thickness of the substrate is about 8 mils, the open areas are in the form of squares about 20 mils on a side disposed in a square array, and the width of the grid members between adjacent open areas is about 3 mils.

34. The improved vacuum tube device of claim 29 wherein the thickness of the grids is between about 0.1 micron and about 25 microns.

35. The improvement of claim 29 wherein the peripheries of each permanently aligned pair of open areas are also in alignment with the periphery of the intervening opening through the substrate.

36. A method for making self-aligned double grids comprising the steps of:

(a) providing a substrate of electrically non-conducting material, said substrate having first and second outer peripheral edge areas interconnected by a major surface;

(b) employing a laser beam to form at least one cut-out extending through said substrate, said cut-out having an interior peripheral edge area interconnecting a first aperture lying in the plane of said first peripheral edge area and a second aperture lying in the plane of said second peripheral edge area; and (c) applying a first thin planar layer of a conducting material to said first peripheral edge area and a second thin planar layer of a conducting material to said second peripheral edge area, said first conducting layer being electrically isolated from said second conducting layer.

37. The method of claim 36 wherein said cut-out is provided by penetrating the laser beam between said first and second outer peripheral edge areas of said substrate and scanning said beam about the periphery of the cut-out to be formed.

38. The method of claim 34 wherein said cut-out is provided by drilling a series of overlapping holes with the laser beam between said first and second outer peripheral edge areas and about the periphery of the cut-out to be formed.

39. The method of claim 37 or 38 further including the step of immersing said substrate in an etchant in which the material of said substrate is soluble thereby enhancing removal of the material of said substrate interior to said periphery.

40. The method of claim 36 wherein the material of said substrate is alumina.

41. The method of claim 40 wherein said conducting material of said first and second thin planar layers is tungsten.

42. The method of claim 36 wherein the thickness of said first thin planar layer of a conducting material and the thickness of said second thin planar layer of a conducting material is between about 0.1 micron and about 25 microns.

43. A method for making self-aligned double grids comprising the steps of:

(a) providing an electrically non-conducting substrate, said substrate having first and second major surfaces and an outer peripheral edge area interconnecting said major surfaces;

(b) applying a first thin planar layer of a conducting material to said first major surface and a second thin planar layer of a conducting material to said second major surface to form an assembly; and (c) employing a laser beam to provide at least one cut-out through said assembly, said cut-out having an interior peripheral edge area interconnecting a first aperture lying in the plane of said first layer and a second aperture lying in the plane of said second layer forming thereby said self-aligned double grid, said first layer of said double grid being electrically isolated from said second layer of said double grid.

44. The method of claim 43 wherein a plurality of said cut-outs are provided, said cut-outs being arranged in an array in at least a portion of said assembly

45. The method of claim 43 wherein said cut-out is provided by penetrating a laser beam through the thickness of said assembly and scanning said beam about the periphery of the cut-out to be formed.

46. The method of claim 43 wherein said cut-out is provided by drilling by means of a laser beam a series of overlapping holes through the thickness of said assembly and about the periphery of the cut-out to be formed.

47. The method of claim 45 or 46 further including the step of immersing said substrate in an etchant in which the material of said substrate is soluble

48. The method of claim 43 wherein the material of said substrate is alumina.

49. The method of claim 48 wherein said conducting material of said first and second thin planar layers is tungsten.

50. The method of claim 43 wherein the thickness of said first thin planar layer of a conducting material and the thickness of said second thin planar layer of a conducting material is between about 0.1 micron and about 25 microns.

* * * * *